US005581849A

United States Patent [19]

Kriegler et al.

[11] Patent Number: 5,581,849

[45] Date of Patent: Dec. 10, 1996

[54] PROCESS FOR POSITIONING A FIBER SLIVER ON A FLAT CAN

[75] Inventors: Albert Kriegler, Rottenegg; Bernhard Mohr, Titting, both of Germany

[73] Assignee: Rieter Ingolstadt Spinnereimaschinenbau AG, Ingolstadt, Germany

[21] Appl. No.: 437,142

[22] Filed: May 5, 1995

[30] Foreign Application Priority Data

May 13, 1994 [DE] Germany ..... 44 16 911.6
May 13, 1994 [DE] Germany ..... 44 16 947.7

[51] Int. Cl.[6] ..... D01G 27/00; B65H 67/04

[52] U.S. Cl. ..... 19/159 A

[58] Field of Search ..... 19/159 A, 159 R; 57/281

[56] References Cited

U.S. PATENT DOCUMENTS 4,526,095 7/1985 Rewitzer .
4,561,151 12/1985 Schöpwinkel .
4,965,912 10/1990 Kluttermann et al. ..... 19/159 R
5,172,453 12/1992 Akiyama ..... 19/159 R
5,237,726 8/1993 Gartenmann et al. .
5,448,801 9/1995 Wolfgang et al. ..... 19/159 A

FOREIGN PATENT DOCUMENTS

0468224A1 1/1992 European Pat. Off. .
0574659B1 3/1993 European Pat. Off. .
0615944A1 2/1994 European Pat. Off. .
2821325 11/1979 Germany ..... 19/159 R
4107309A1 10/1991 Germany .
4324948A1 1/1995 Germany .
017864 2/1981 Japan ..... 19/159 R
1164917 9/1969 United Kingdom .
2039548 8/1980 United Kingdom .
2044304 10/1980 United Kingdom .

*Primary Examiner*—Ismael Izaguirre
*Attorney, Agent, or Firm*—Dority & Manning

[57] ABSTRACT

The process for the positioning of a fiber sliver end is characterized in that in the stopped position of the flat can a drafting point is formed in the fiber sliver between the pair of calendar rollers and the sliver guiding channel and in that subsequent displacement of the flat can into a transfer position causes the fiber sliver to be severed at the drafting point and to be pulled out of the rotary plate, so that it is positioned with a constant length on the flat can.

8 Claims, 5 Drawing Sheets

PROCESS FOR POSITIONING A FIBER SLIVER ON A FLAT CAN

BACKGROUND OF THE INVENTION

The instant invention relates to the positioning of a fiber sliver end on a full flat can which is to be exchanged against an empty flat can after being filled on a draw frame.

The draw frame processes the fiber sliver and deposits the fiber sliver cycloidally in layers. When the flat can is full, it is replaced by an empty one. For this, the fiber sliver must be severed and the sliver end must be deposited against the can edge of the flat can.

If the severed fiber sliver end lies in a random position against the edge of the can it must be located by expensive, automatic devices and delays occur in positioning the flat can in the conveying system or machine for further processing. Finally, further processing is delayed.

In order to avoid these disadvantages, the utilization of a holding device to hold the fiber sliver in a defined position against the edge of the can is known. The holding device is installed as an addition on the edge of the can. The fiber sliver end must be deposited into this holding device. It is expensive to always use an additional holding system on the flat can and to design the edge of the can so that the holding device may be installed.

It is however not possible to do without positioning the fiber sliver end. This is a requirement for automation for subsequent operating steps in a spinning plant. With a constantly reproducible position of the sliver end in the can edge, it is possible to keep the expenses in subsequent operating phases or in piecing the fiber slivers to machines for further processing down or to reduce them.

If the fiber sliver end could be deposited at a constantly reproducible position on the can edge without requiring any additional holding system, this would contribute considerably to lowering the expense.

From this point of view, the German application P 43 24 948.5 succeeds in positioning the fiber sliver end without a holding system at the can edge in a reproducible manner. The positioning of the fiber sliver end on the flat can is achieved in that, starting from the stopped position of the flat can, the outlet of the rotary plate relative to the longitudinal axis of the flat can is positioned and stopped in such a manner that the fiber sliver loops are withdrawn in such manner when the flat can is displaced, that the fiber sliver comes to lie at the end of the displacement path in the central area of the forward face of the flat can and is then severed by a severing device. The filled flat can is standing in a stopped position beneath the rotary plate and is displaced from this position, and only then is the fiber sliver severed. As a result of the high degree of static friction of the fiber sliver, automatic unwinding of the fiber sliver loops may influence the unwound fiber sliver.

In another embodiment for the positioning of the fiber sliver, it is shown that following the positioning of the rotary plate outlet in a stopped position of the flat can, the fiber sliver is first severed between the pair of calendar rollers and the sliver guiding channel by means of a mechanical severing device. Following severing, the flat can is shifted into a transfer position. In this process, the severed sliver end is pulled out of the sliver guiding channel and hangs down on the forward face of the flat can at a positioned location and in suitable length. The fact that the positioning process requires a complete severing device of a known type is expensive. The severing device often has the disadvantage that the fiber sliver is deflected during the severing process and that the severed sliver end hangs down on the edge of the sliver guiding channel. This impedes the re-starting of the machine.

OBJECTS AND SUMMARY OF THE INVENTION

It is a principal object of the invention to avoid a reduction of quality of the fiber sliver in positioning the fiber sliver and at the same time to further reduce the cost for positioning the sliver end on a flat can. Additional objects and advantages of the invention will be set forth in part in the following description, or may be obvious from the description, or may be learned through practice of the invention.

When the flat can reaches its full state, its traversing is ended and the delivery of the fiber sliver is stopped. The pair of calendar rollers and the rotary plate are stopped. The flat can is standing at the end point of its traversing, with one forward face directly under the rotary plate. This is the stopped position in which the transfer of the flat can to a downstream conveying system is ensured. In this stopped position of the flat can, the outlet of the rotary plate is positioned, i.e. the outlet of the rotary plate is always stopped in the same position relative to the stopped position of the flat can. With this defined position of the outlet of the rotary plate, it is possible to determine at which position of the edge of the forward face of the flat can the fiber sliver is to be deposited.

Since the fiber sliver is deposited cycloidally, the positioning of the outlet of the rotary plate influences the formation of the last loop. The rotary plate outlet is stopped in a positioned condition relative to the longitudinal axis of the flat can. The positions can be selected. It is thus possible to determine at which position the loop end should enter the outlet of the rotary plate (sliver guiding channel).

Positioning of a fiber sliver is achieved through interaction between a drafting device and a displacement device. The process for the positioning of a fiber sliver end is characterized in that a drafting point is formed in the fiber sliver between the pair of calendar rollers and the sliver guiding channel by means of a drafting device while the flat can is in its stopped position, and in that a subsequent displacement of the flat can by means of displacement means from its stopped position into a transfer position, severs the fiber sliver at the drafting point and the severed sliver end is pulled out of the sliver guiding channel so that it is positioned at a constant length at the edge of the forward face of the flat can. The drafting device is formed in that a clamping point is constituted by the drafting device at a distance equal to at least one staple length below the pair of calendar rollers by clamping the fiber sliver and in that this clamping point is displaced by the displacement device at a right angle to the conveying direction of the fiber sliver until drafting takes place. A drafting point is created between the clamping point and the pair of calendar rollers. Clamping of the fiber sliver by the displacement device is then stopped.

The drafting point could also be formed by moving the drafting device in the direction of the sliver guiding channel. The drafting device may be a movable clamping device or a movable mechanical lever or stop. The subsequent displacement of the flat can may be realized by means of displacement means. Displacement means may be the utilization of the traversing means and/or of additional conveying means for the flat cans. The movements of the drafting device and of the displacement device are controlled by the machine controls.

These process steps in positioning a sliver end have the advantage that they simplify the overall process. This means that a conventional, expensive severing device for the fiber sliver can be omitted. Although the fiber sliver with its drafting point is deflected from its conveying direction, it is brought back before the severing process into the conveying direction through displacement of the displacement means. Furthermore, the severed sliver end is positioned in the sliver guiding channel as it hangs from the pair of calendar rollers.

In severing by displacement, the drafting point always ensures a defined severing point of the sliver. The device to carry out the process has displacement means for a flat can and a drafting device which are connected to controls. The drafting device has at least one controlled and movable clamping arm and stop as operating means.

Positioning is achieved at a lower cost than with the state of the art. An additional advantage is the fact that the length of the sliver end can be influenced in that the stopped position of the flat can may be varied somewhat additionally.

The operation and the inventive characteristics of the invention are explained through an example of an embodiment below.

DETAILED DESCRIPTION OF THE PREFERRED EMBODIMENTS

Figure 1:
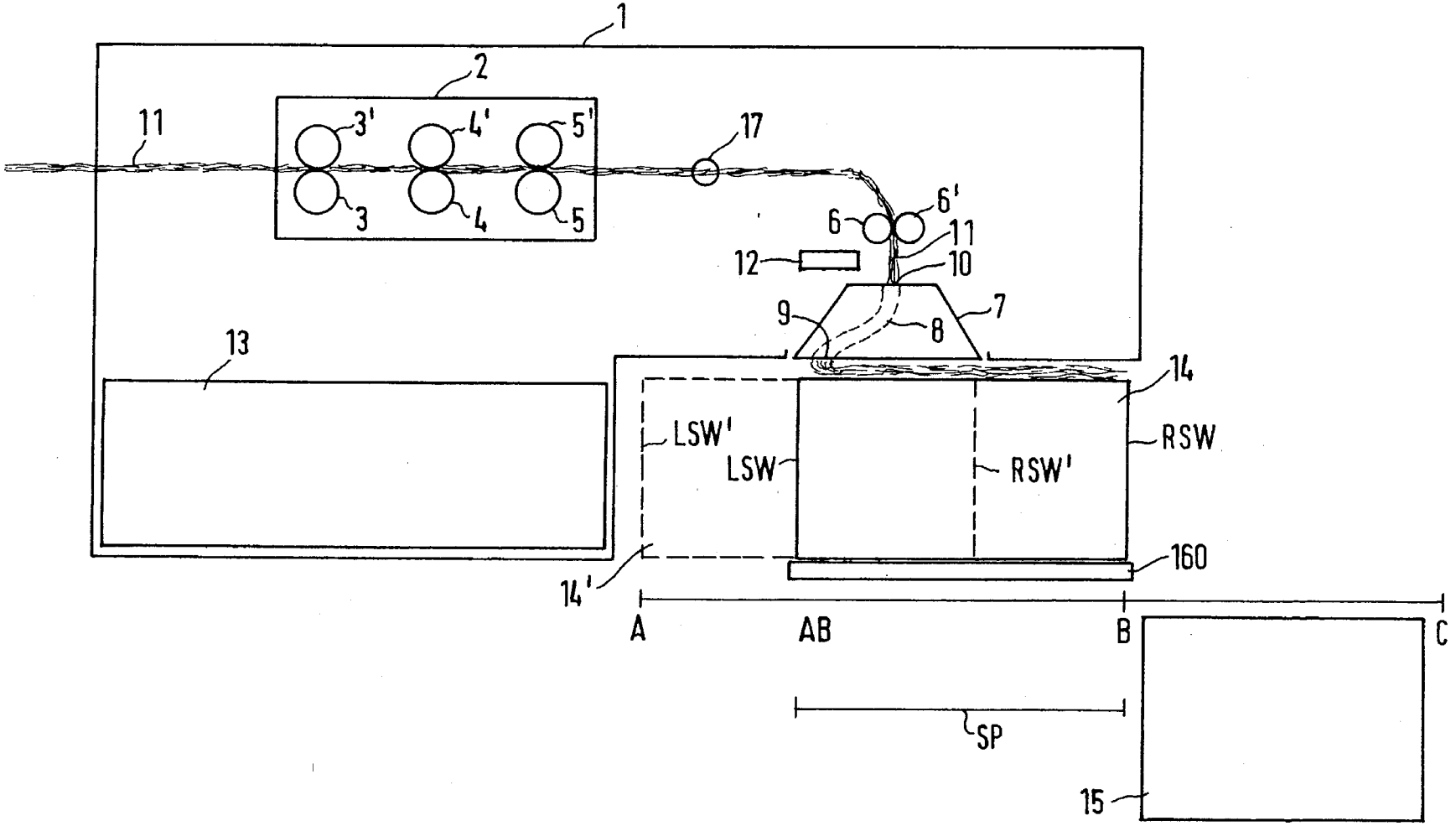
FIG. 1 shows a draw frame with traversing device.

Reference will now be made in detail to the preferred embodiments of the invention, one or more examples of which are illustrated in the drawings. Each example is provided by way of explanation of the invention, and not as a limitation of the invention. In fact, it will be apparent to those skilled in the art that various modifications and variations can be made in the present invention without departing from the scope and spirit of the invention. The numbering of components in the drawings is consistent throughout, with the same components having the same number in each of the drawings.

FIG. 1 schematically shows a draw frame 1 of the textile industry as well as a flat can 14 and its displacement means 16 (traversing device) as well as the buffer 15 of a conveying system for flat cans. The fiber sliver 11 is drafted in the drafting equipment 2 in the draw frame 1. The drafting equipment 2 is represented by the pairs of drafting rollers 3, 3'; 4, 4'; 5, 5'. At the outlet of the drafting equipment 2 is a measuring element 17 to measure the delivered fiber sliver length. The fiber sliver 11 is delivered to a pair of calendar rollers 6, 6' and is conveyed from the pair of calendar rollers 6, 6' into the sliver guiding channel 8 of a rotary plate 7. The rotary plate 7 rotates, so that the fiber sliver is deposited via its outlet 9 in a flat can 14 below. The flat can 14 has a rectangular bottom surface. In its empty state a movable can plate is below or at the level of the upper edge of the can. As the filling of the can increases, the can plate is moved downward against the force of a spring below, in the direction of the can bottom. The flat can 14 has narrow sides, i.e. side LSW and side RSW. The flat can is placed on a traversing device 160. The traversing device 160 has a drive with control device which is not shown here. During the filling process the flat can 14 is traversed below the rotary plate, between the two reversal points A and B of its traversing path AB. The flat can thus moves between the two shown positions of the flat can 14 and the flat can 14' (broken line). The rotation of the rotary plate 7 and the traversing of the flat can causes the fiber sliver to be deposited cycloidally on the can plate of the flat can. The deposit goes from one face of the flat can to the other face and back. A depositing path from one face to the other constitutes in each case one layer of fiber sliver loops. A full flat can has a plurality of such layers. The traversing speed of the flat can 14 is synchronized with the delivery speed of the rotary plate 7. Starting, operation, and braking of rotary plate and flat can are synchronized. When the measuring element 17 registers the attained limit value of the delivered fiber sliver length, it transmits at the same time a signal to the machine controls 13. The machine controls 13 causes the drives of the rotary plate 7 and of the traversing device 160 to stop at a defined point in time. This stoppage is such that the flat can 14 reaches a position in proximity of or at the return point B as it is stopped, i.e. the face RSW is in proximity of or at the return point B and the face LSW is in the area below the rotary plate 7. The flat can 14 is therefore located in its stopped position SP on the traversing path AB. This stopped position SP could be varied slightly by stopping in proximity of the return point. Thereby the length of the future sliver end can be influenced.

Figure 2:
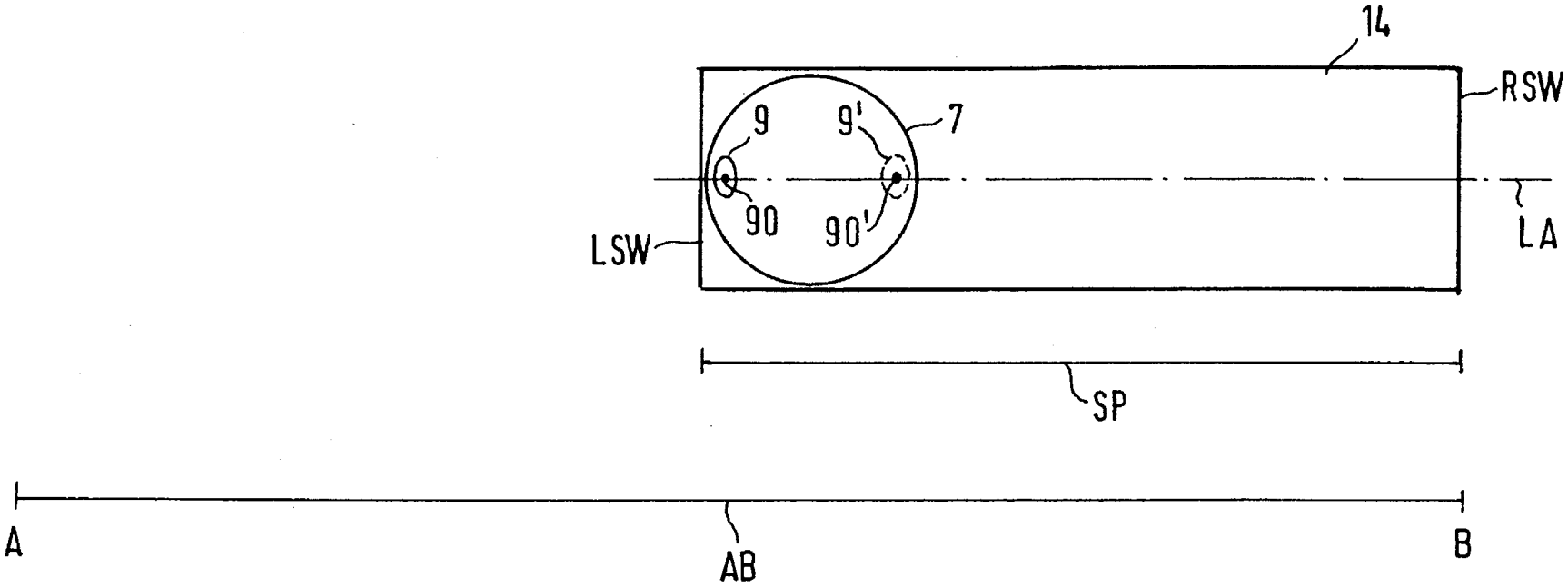
FIG. 2 shows the allocation of the rotary plate to the flat can.

FIG. 2 schematically shows the allocation of the rotary plate 7 in a top view of the flat can. The flat can 14 is in its stopped position SP on the traversing path AB. The rotary plate 7 is located above the flat can 14. The position of the rotary plate 7 relative to the stopped position SP of the flat can 14 is positioned, i.e. the rotary plate 7 is for example always stopped so that the outlet 9 of the sliver guiding channel 8 always comes to a stop in the same position. The position of the outlet 9 is advantageously set so that the fiber sliver 11 is vertically in the longitudinal axis LA of the flat can. This is position 90 of outlet 9. A second possibility is afforded when the rotary plate, rotated by 180°, reaches position 90' with its outlet 9'. However, some other position of the rotary plate outlet 9 is also possible. The deposit of the last loop is influenced by the position of the rotary plate outlet 9. It is thus possible to determine at which position the loop end goes into the rotary plate outlet. The selection of other positions depends on the displacement step to be discussed further below.

Figure 3:
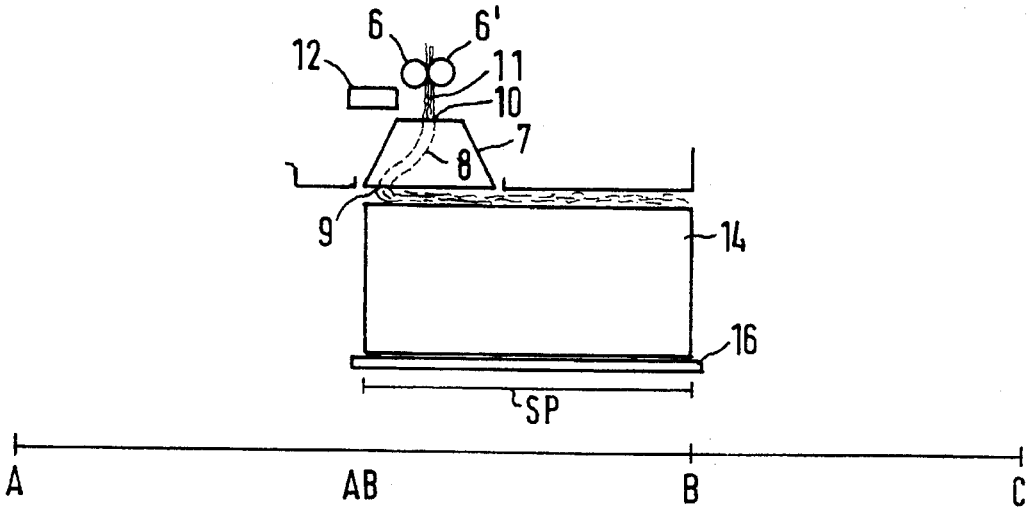
FIG. 3 shows the flat can in its stopped position.

FIG. 3 shows that the flat can 14 is put in its stopped position SP. At the same time the delivery of fiber sliver 11 by the pair of calendar rollers 6, 6' is stopped. This stopping is caused by the machine controls 13. The fiber sliver 11 hangs in the sliver guiding channel 8, goes through the sliver guiding channel and lies in the flat can 14. Now a drafting device 12 receives the signal from the machine controls 13 to draw the fiber sliver between the pair of calendar rollers 6, 6' and the inlet opening 10 of the sliver guiding channel 8, i.e. to form a drafting point.

Figure 3A:
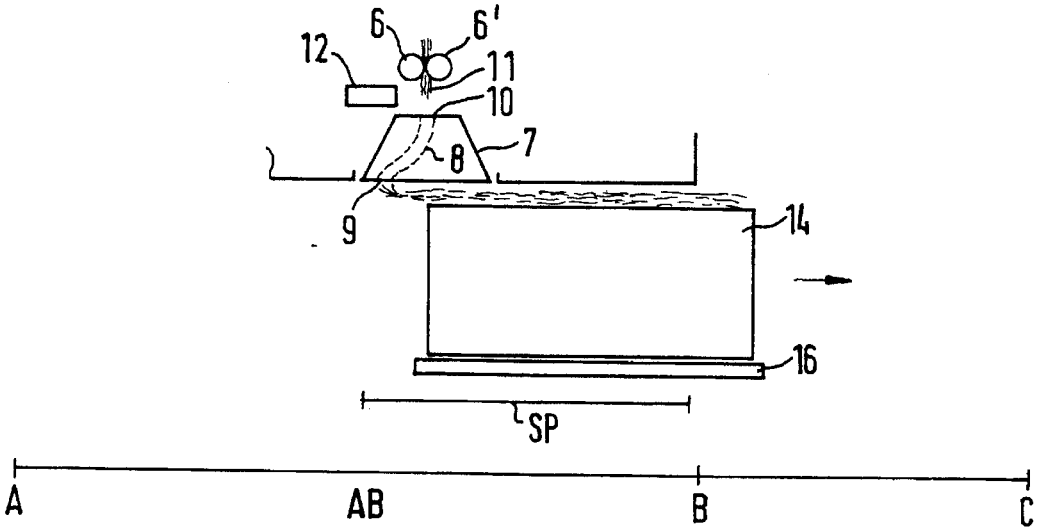
FIG. 3*a* shows the displacement of the flat can from its stopped position.
Figure 3B:
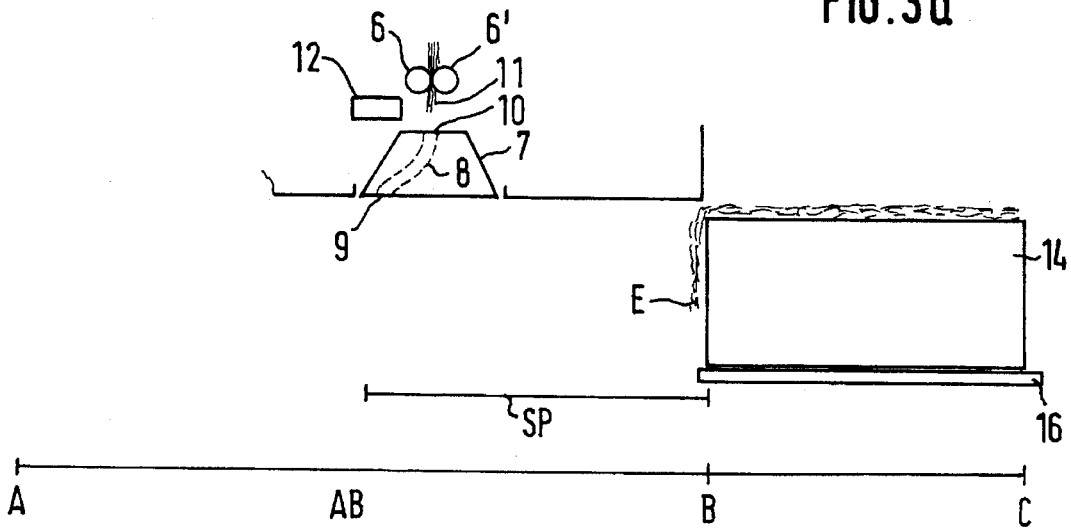
FIG. 3*b* shows the flat can in transfer position.

FIG. 3*a* shows that the flat can 14 is now displaced from its stopped position SP by means of displacement means 16 in the direction of a transfer position C. In this process the drafting point is severed and the fiber sliver end is drawn by the can movement out of the sliver guiding channel 8. In FIG. 3*b* the flat can 14 has reached the transfer position C. The fiber sliver E hangs down on the face LSW of the flat can 14. Since the rotary plate 7 was positioned, for example, with its outlet 9 in the longitudinal axis LA, the fiber sliver end is deposited in the central area of face LSW.

Figure 4:
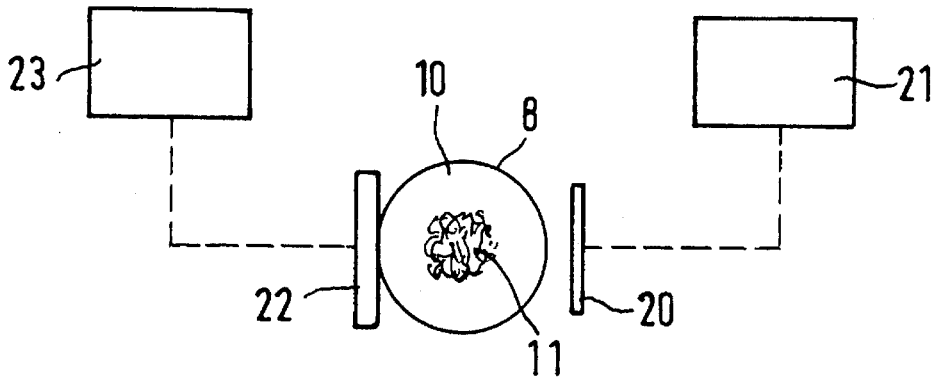
FIG. 4 shows the starting position of the fiber sliver severing.
Figure 4A:
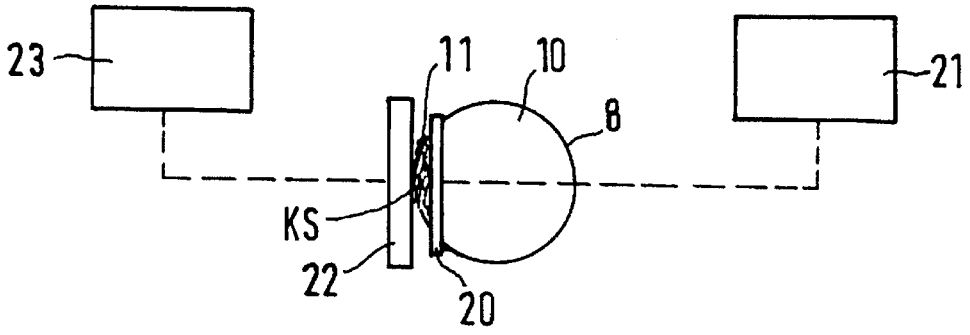
FIG. 4*a* shows the clamping of the fiber sliver.
Figure 4B:
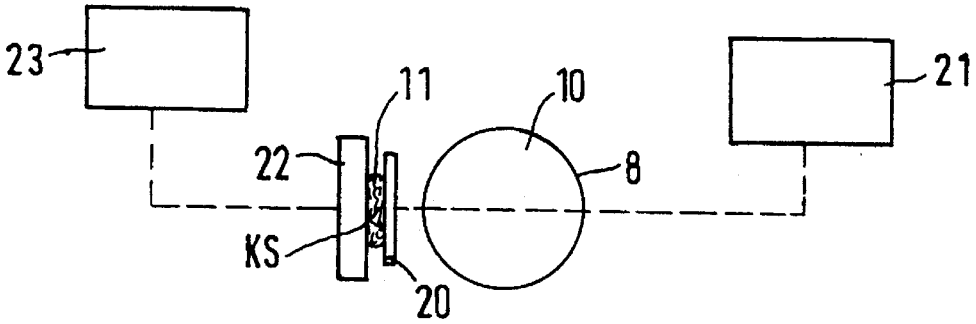
FIG. 4*b* shows the displacement of the clamping point.
Figure 4C:
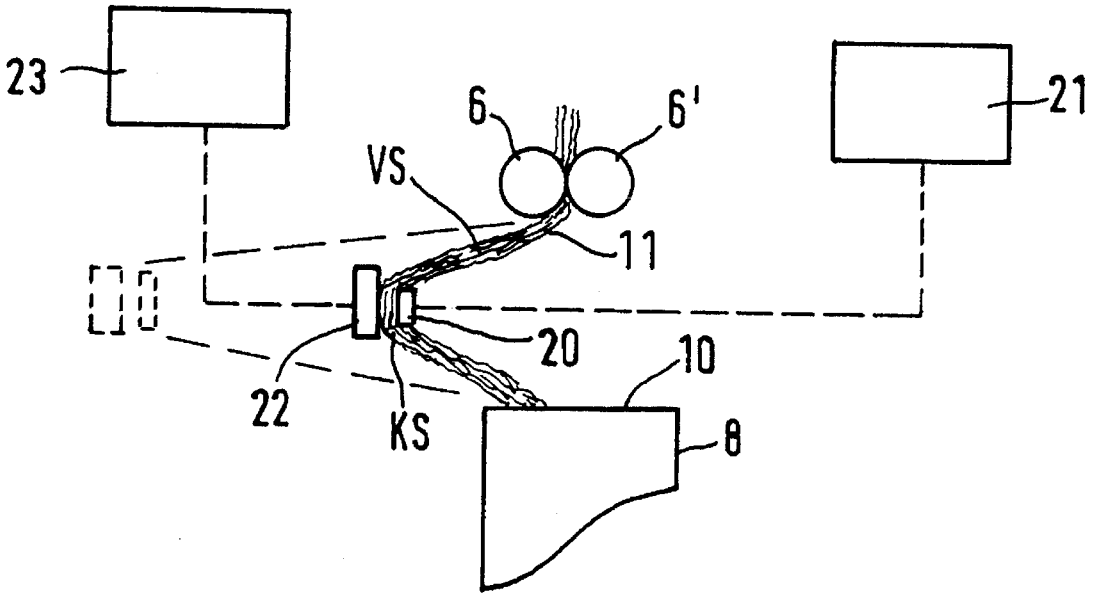
FIG. 4*c* shows the drafting in the fiber sliver.
Figure 4D:
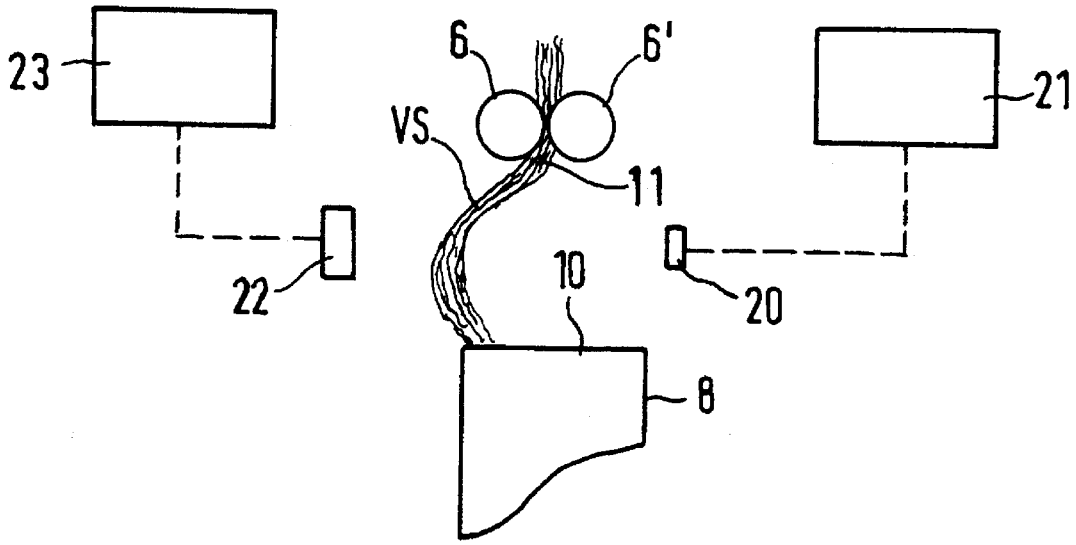
FIG. 4*d* shows the opening of the clamping point.

FIGS. 4 to 4*d* show the formation of a drafting point in the fiber sliver by means of a drafting device. FIG. 4 shows in a schematic top view the starting position of the drafting device, i.e. the operating means clamping arm 20, stop 22 and their adjusting devices 21 and 23. Furthermore the inlet opening 10 of the sliver guiding channel 8 in which the fiber sliver 11 is located is shown schematically. A stop 22 is located next to the inlet opening 10. This stop is held mechanically and is moved by an adjusting device 23. This adjusting device is equipped with a drive (not shown) and its controls as well as a displacement mechanism. A clamping arm 20 is located across from stop 22, and is also outside the inlet opening 10. This clamping arm 20 is held and moved mechanically by the adjusting device 21. This adjusting device is provided with a drive (not shown) and its controls as well as with a displacement mechanism. The clamping arm 20 is moved by the adjusting device 21, e.g. at a right angle to the conveying direction of the fiber sliver 11. The clamping arm 20 deflects the fiber sliver 11 and clamps it with stop 22. Stop 22 and clamping arm 20 constitute a clamping point KS. The clamping point KS is displaced further across, in continuation of the previous movement of the clamping arm 20. This displacement of the clamping pointers shown by comparing FIGS. 4*a* and 4*b*. The displacement of the clamping point KS continues until drafting of the fiber sliver occurs. FIG. 4*c* shows this drafting point. For greater clarity, a lateral view is shown. The drafting point VS occurs between the clamping point KS and the pair of calendar rollers 6, 6'. This displacement path is determined as a function of the material to be processed and is set by controlling the adjusting devices 21 and 23. When drafting has been achieved and a drafting point has been created, the clamping point KS is opened, i.e. the clamping arm 20 is brought back into its starting position. As the next step for the positioning of a sliver, the displacement of the flat can 14 into transfer position C as shown in FIGS. 3 to 3*b* is now carried out, e.g. by utilizing the traversing device 160. The displacement of the flat can causes the fiber sliver to be positioned with the drafting point precisely in the conveying direction of the sliver, i.e. in the sliver guiding channel, and the sliver is severed precisely at the drafting point. At the same time the sliver end is pulled out of the sliver guiding channel of the rotary plate through the displacement of the flat can. The fiber sliver hangs on a defined position of the flat can. At the same time it is ensured that the fiber sliver end will always have a set length. The flat can 14 can now be displaced by the displacement means 16 from the transfer position C by means of a transfer device (not shown) on the buffer 15 of a conveying system. Thereby it is possible to shift an empty can from buffer 15 to the displacement means 16. The can replacement is thus completed.

It will be apparent to those skilled in the art that various modifications and variations can be made in the present invention without departing from the scope or spirit of the invention. For example, features illustrated or described as part of one embodiment can be used on another embodiment to yield a still further embodiment. It is intended that the present invention cover such modifications and variations as come within the scope of the appended claims and their equivalents.

We claim:

1. A process for the positioning of a fiber sliver of a filled flat can, wherein the fiber sliver is conveyed to the flat can by a pair of calendar rollers through a sliver guiding channel of a rotary plate and deposited cycloidally in the flat can, said process comprising:

stopping fiber sliver delivery for can replacement;

bringing the flat can to a stopped position;

stopping the rotary plate so that an outlet of the rotary plate is in a predetermined known position relative to the flat can;

with the flat can in its stopped position, defining a drafting point in the fiber sliver with a drafting device between the pair of calendar rollers and the sliver guiding channel; and severing the fiber sliver at the drafting point by displacing the flat can with a displacing device from its stopped position after defining the drafting point, the severed sliver end thereby being pulled out of the sliver guiding channel with a constant length.

2. The process as in claim 1, wherein said defining of a drafting point comprises defining a clamping point with the drafting device at a distance below the pair of calendar rollers which is at least equal to one staple length of fibers of the fiber sliver, and displacing the clamping point at essentially a right angle to the conveying direction of the fiber sliver until drafting of the fiber sliver occurs essentially at the location of the clamping point.

3. The process as in claim 2, further comprising defining the clamping point with a movable clamping arm and a stop.

4. The process as in claim 1, further comprising varying the length of the severed fiber sliver end by varying the stopped position of the flat can.

5. The process as in claim 1, further comprising controlling operation of the drafting device and displacing device from a common control.

6. The process as in claim 1, wherein said displacing of the flat can with a displacing device comprises moving the flat can with a traversing device.

7. The process as in claim 1, wherein said displacing of the flat can comprises moving the flat can from its stopped position to a transfer position.

8. The process as in claim 1, further comprising positioning the constant length of severed sliver end over an edge and onto a face of the flat can, said position determined by the known position of the rotary plate relative to the flat can.

* * * * *